US005937478A

United States Patent [19]

Regnier

[11] Patent Number: 5,937,478

[45] Date of Patent: Aug. 17, 1999

[54] SLIDING DOOR CLOSING DEVICE

[76] Inventor: Paul Regnier, 31126 Deertrail Drive, Clearbrook, Canada, V2T 5J5

[21] Appl. No.: 09/038,763

[22] Filed: Mar. 11, 1998

[51] Int. Cl.[6] ..... E05F 1/08

[52] U.S. Cl. ..... 16/78; 16/77

[58] Field of Search ..... 16/78, 76, 77, 16/75, 63, 64

[56] References Cited

U.S. PATENT DOCUMENTS

| | | | |
|---|---|---|---|
| 3,246,363 | 4/1966 | Rogas et al. . | |
| 3,332,638 | 7/1967 | Jessup et al. . | |
| 3,480,227 | 11/1969 | Matthews | 16/78 |
| 3,502,280 | 3/1970 | Jessup et al. . | |
| 4,675,938 | 6/1987 | Bundschuh | 16/64 |
| 4,757,642 | 7/1988 | Hahn . | |
| 5,630,249 | 5/1997 | Rebai, Jr. | 16/78 |

*Primary Examiner*—Chuck Y. Mah
*Attorney, Agent, or Firm*—Christensen O'Connor Johnson & Kindness PLLC

[57] ABSTRACT

A device for closing a sliding door includes a housing that attaches to the trailing edge of the sliding door. A tensioned cable extends from a spool in the housing to the door frame. When the sliding door is opened, the cable extends and undergoes an increase in tension. When the door is released, the cable is retracted and undergoes a decrease in tension as it forces the door closed. Cable tensioning is provided by a torsion spring that connects the cable spool to a concentric ratcheted axle. The device permits the user to readily increase or decrease the tension of the cable independently of the amount of cable extended by either ratcheting the axle with respect to the spool or by releasing the ratchet pawl.

9 Claims, 2 Drawing Sheets

SLIDING DOOR CLOSING DEVICE

FIELD OF THE INVENTION

The present invention relates to a device for closing sliding doors.

BACKGROUND OF THE INVENTION

Sliding screen doors are frequently located in high traffic areas, such as between a kitchen and a deck or between a recreation room and a backyard. People passing through such doors are often carrying something, such as a tray of refreshments, patio furniture, or sports equipment and therefore have difficulty closing the door behind them. To keep insects and debris from creeping inside the house, it is desirable to have a device that will automatically close the sliding door.

Many such devices for automatically closing sliding doors are known; however, these prior devices suffer from a combination of a number of deficiencies. These devices are generally complicated mechanisms that must be permanently installed about the door frame, aligned, and then calibrated to overcome the resistance of the particular door. Once installed, these mechanisms are difficult to bypass or temporarily defeat, making it hard to keep the door open on occasion when desired. Furthermore, many such devices obstruct the doorway with whatever member or cable pulls the sliding door closed, thereby increasing the opportunity for accident or injury.

What is needed is a device that will automatically close a sliding screen door that is not subject to these deficiencies. The present invention is directed to such a device.

SUMMARY OF THE INVENTION

According to one aspect of the invention there is provided a device for closing a screened sash that slides substantially horizontally within a frame, the sash having a leading edge which meets the frame and a trailing edge opposite the leading edge, the device comprising: a housing, means for engaging the housing to the trailing edge of the sash, a cable having a first end anchored within the housing and a second end adapted to engage the frame, an axle passing through the housing transversely to the longitudinal axis of the cable and adapted to rotate freely within the housing, a spool circumscribing the axle for free rotation thereabout and fixedly retaining the first end of the cable for dispensing or storing the cable, a ratchet gear fixedly and coaxially engaging the axle, a pawl having a clasp end and a counterbalance end, the pawl pivotably engaging the housing such that the clasp end is positioned to releasably engage the ratchet gear, means for urging the clasp end of the pawl to engage the ratchet gear so that the axle remains fixed while the spool rotates out of rotationally alignment therewith, and means for urging the spool back into rotational alignment with the axle whereby as cable is dispensed from the spool, the spool urging means urges the spool to retract the cable.

In this device, the pawl engagement urging means might be a compression spring having a first end affixed to the housing and a second end engaging the counterbalance end of the pawl and the spool urging means might be torsion spring having a first end affixed to the spool and a second end affixed to the axle. The device might further include means for ratcheting the axle so as to increase the tension in the torsion spring.

The device might further include means for urging the clasp end of the pawl to disengage the ratchet gear so that the axle may freely rotate about the spool and such means might be a member that urges the pawl against the pawl engagement urging means.

The engaging means is a tongue adapted to engage the trailing edge of the sash or a groove adapted to engage the trailing edge of the sash.

The device might also include an elongated member adapted to slideably engage the housing between a first position substantially retracted within the housing and a second position alternate position partially extended from the housing, in which second position the elongated member engages both the housing and the frame to oppose translation therebetween.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENT

Figure 1A:
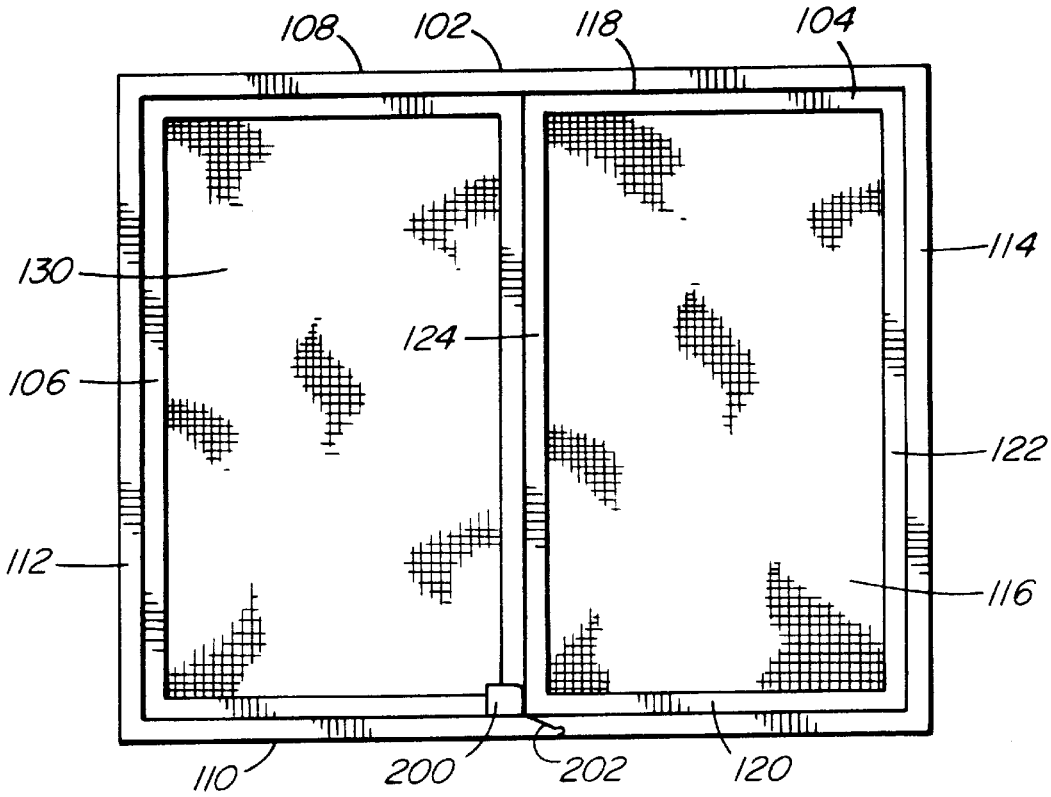
FIG. 1*a* is a side view of a device embodying one aspect of the invention engaging a closed sliding door.
Figure 1B:
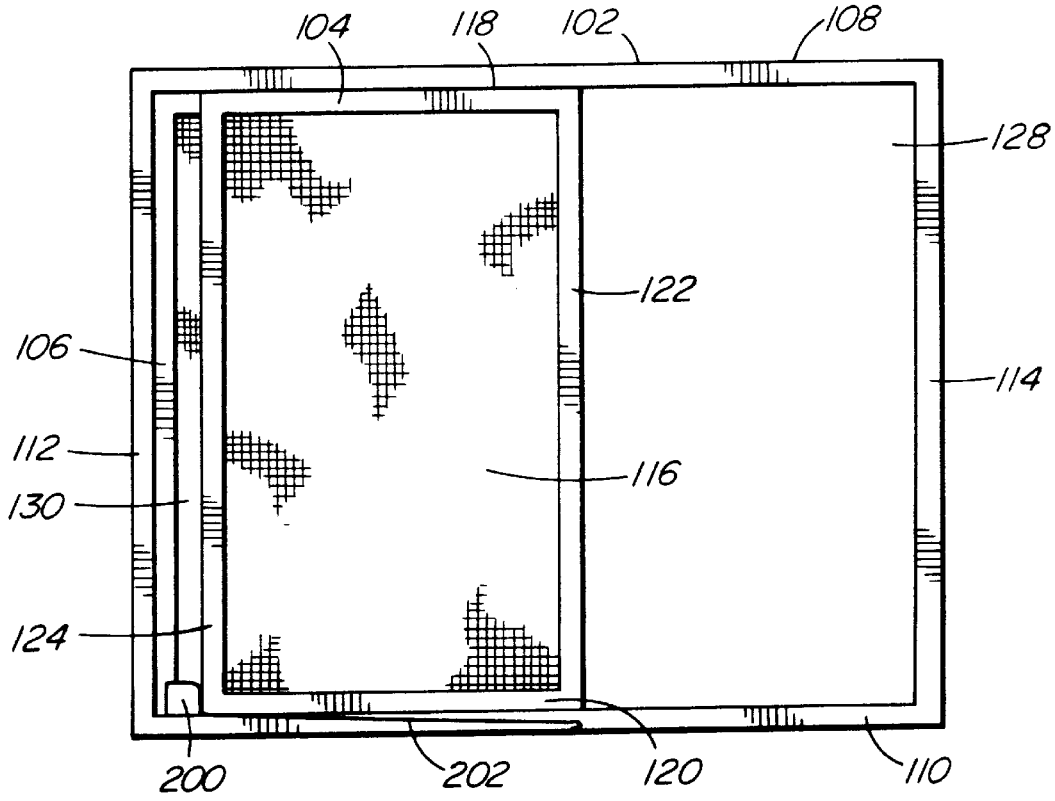
FIG. 1*b* is a side view of the device of FIG. 1*a*, engaging an open sliding door.

With reference now to FIG. 1, there is illustrated a door frame 102 around a sliding door sash 104 and a fixed door sash 106. The frame 102 includes a head track 108 and sill track 110 for slideably retaining the sliding door sash 104 and for fixedly retaining the fixed door sash 106. The frame 102 further includes a first jamb 112 for separating the head and sill tracks 108, 110 and for fixedly retaining the fixed door sash 106 and a second jamb 114 for separating the head and sill tracks 108, 110 and for releasably retaining the sliding door sash 104.

The sliding sash 104 retains a first pane 116 of mesh made from metal, plastic or other appropriate material. The sliding sash 104 has a top edge 118 for slidable engagement with the head track 108 and a bottom edge 120 for slidable engagement with the sill track 110. The sliding sash 104 further has a leading edge 122 for releasable engagement with the second jamb 114 and a trailing edge 124 opposite the leading edge 122, the trailing edge 124 defining a channel 126 (best viewed in FIG. 2). When the leading edge 122 is engaged by the second jamb 114, the sliding sash 104 is said to be in its closed position. When the leading edge 122 is disengaged from the second jamb 114, the sliding sash 104 is said to be in an open position. The space within the door frame 102 between the leading edge 122 and the second jamb 114 when the sliding sash 104 is in an open position defines a doorway 128.

The fixed door sash 106 retains a second pane 130 of mesh made from metal, plastic or other appropriate material. The fixed sash 106 is fixedly engaged by the head track 108, the sill track 110, and the first jamb 112.

A door closing device embodying a first aspect of the invention, hereinafter referred to as a, "closer," is illustrated generally at 200. The closer 200 is adapted to engage the trailing edge 124 of the sliding door sash 104. The closer 200 includes a retractable cable 202 which is adapted to engage the sill track 110 such that when the sliding sash 104 is closed, a small amount of the cable 202 extends from the closer 200 in the direction of the second jamb 114. It should be noted with the sliding sash 104 in either open or closed positions, the cable 202 does not significantly obstruct the doorway 128. It should be understood that the cable 202 might be replaced with string, thread, wire, or any suitably strong yet flexible elongated material.

Figure 2:
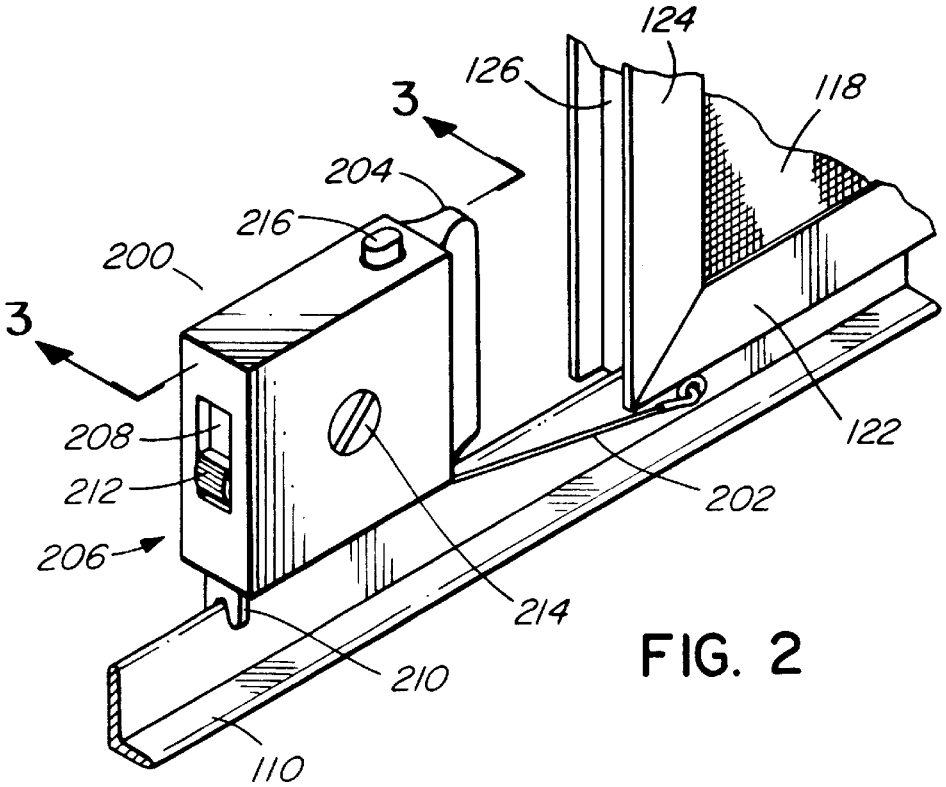
FIG. 2 is perspective end view detailing the connection of the device of FIG. 1 to the sliding door.

With reference now to FIG. 2, the closer 200 is illustrated in greater detail. The closer 200 includes a tongue 204 for insertion into the channel 126 defined by the trailing edge 124 of the sliding door sash 104, the tongue 204 and the channel 126 being adapted so that their engagement is snug but not necessarily permanent.

The closer 200 further includes an extendible brake generally illustrated at 206 which is formed from an elongated member 208 slideably resident within the closer 200 for downward extension, the extended end 210 of the brake being adapted to frictionally engage the sill track 110. The brake 206 might further include a handle 212 connected to the elongated member 208 so as to project from the closure 200 so that a user might slidably operate the elongated member 208 residing within the closer 200.

The closer 200 further includes a dial 214 for increasing the tension on the cable 202 and a button 216 for releasing the tension on the cable 202. Both the dial 214 and the button 216 will be further described with respect to FIG. 3 below.

Figure 3:
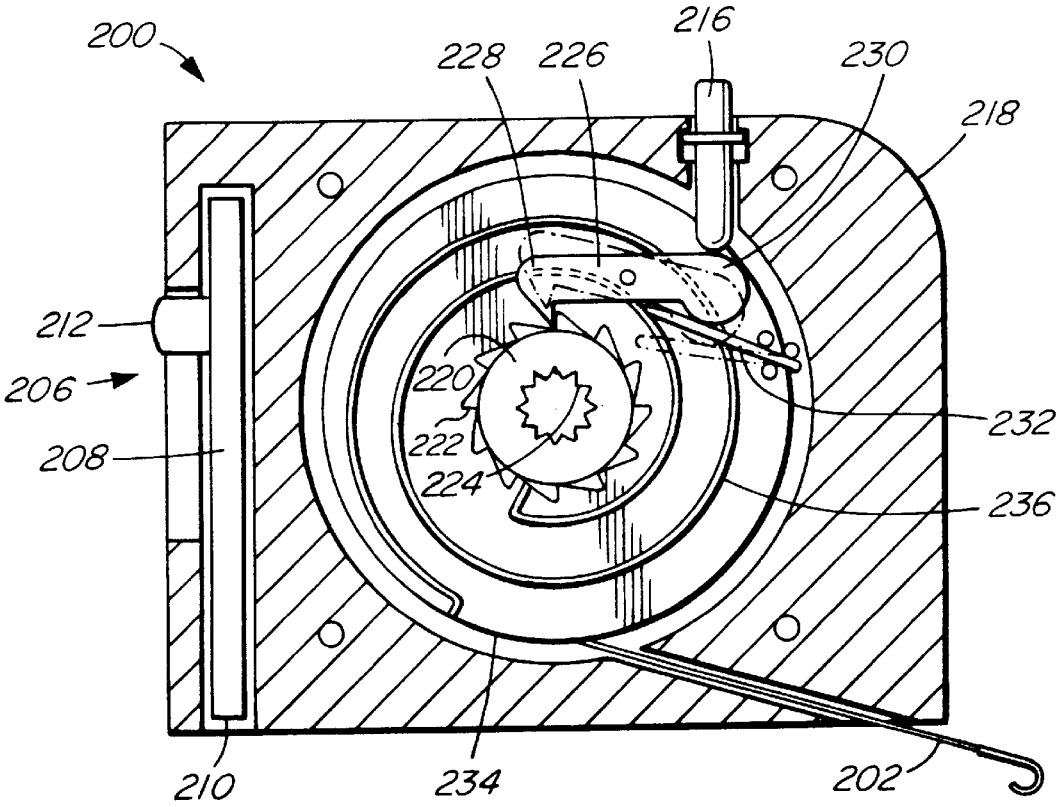
FIG. 3 is a sectional side view of the device of FIG. 2 taken along line 3—3 of FIG. 2.

With reference now to FIG. 3, the mechanism inside the closer 200 is illustrated in greater detail. The closer 200 housing 218 supports a freewheeling tubular axle 220 having an axis of rotation that is transverse to the longitudinal axis of the extended cable 202. The axle 220 supports a coaxial ratchet gear 222 on its exterior surface and a coaxial internal spur gear 224 on its interior surface. The ratchet gear 222 and the internal gear 224 might either be integrated into one piece with the axle 220 as shown or might alternatively be separate elements that are press fit or bonded to the axle 220 and each other.

Adjacent to the ratchet gear 222, the housing 218 supports a pawl 226 pivotally mounted between its clasp end 228 and its counterbalance end 230 to the housing 218. The clasp end 228 of the pawl 226 is adapted to releasably engage the ratchet gear 222 on the axle 220 and thereby releasably engage the axle 220 and restrain it from freewheeling rotation within the housing 218. A compression spring 232 is mounted to the housing 218 adjacent to the counterbalance end 230 of the pawl 226 so as to urge the clasp end 228 of the pawl 226 toward the ratchet gear 222. The tension release button 216 is configured to pass through the housing 218 so that when depressed, it will urge the counterbalance end 230 of the pawl 226 toward the compression spring 232 and thereby urge the clasp end 228 of the pawl 226 away from the ratchet gear 222. It should be noted that the ratchet gear 222 preferably has asymmetrical teeth so that the axle 220 may be freely rotated with respect to the pawl 226 in one direction but not the other. The dial 214 is adapted to engage the internal spur gear 124 so as to cause the dial 214 and the axle 220 to rotate together. Alternatively, the dial 214 might be formed as an integral portion of the axle 220.

A spool 234 is adapted for freewheeling rotation about the axle 220 and to fixedly engage the end of the cable 202 not used to engage the sill track 110. A torsion spring 236 engages the axle 220 with one end and the spool 234 with the other end.

In operation, the tongue 204 of the closer 200 is inserted into the channel 126 of the trailing edge 124 of the sliding door sash 104. With the sliding door sash 104 in closed position with the leading edge 122 engaging the second jamb 114, the cable 202 is extended a small amount from the housing 200 toward the second jamb 114 and is releasably secured to the sill track 110, for example with a hook and eye type pair of fasteners.

When the sliding door sash 104 is opened away from the second jamb 114, the trailing edge 124 drives the closer 200 toward the first jamb 112, thereby drawing further cable 202 out of the housing 218. As the cable 202 is drawn out, it rotates the spool 234 against the urging of the torsion spring 236. In its normal position, the pawl 226 restrains the axle 220 from rotating with the spool 234 under the urging of the torsion spring 236; therefore, the torsion spring 236 is wound tighter as the cable 202 is drawn forth.

When the person releases the sliding door sash 104, the torsion spring 236 unwinds and thereby rewinds the spool 234, retracting the cable 202 and pulling the sliding door sash 104 back into its closed position. If the person had wanted to hold the sliding door sash 104 open instead, he or she could depress the brake handle 212 such that the elongated braking member 208 extends from the housing 218 and its braking end 210 is engaged with the sill track 110 with a force sufficient to resist the torsion spring 236.

Because sliding doors have varying weights and resistances, it may be necessary to adjust the tension on the torsion spring 236 so that sufficient but only sufficient force is available to close the door from an open position. To increase the torsion spring 236 tension, the dial 214 is rotated to engage the internal gear 224, causing the ratchet gear 222 to rotatably ratchet under the pawl 226, thereby causing the axle 220 to rotate with respect to the spool 234 and the two ends of the torsion spring 236 to rotate with respect to each other. To reduce the torsion spring 236 tension, the button 216 is depressed, whereby the counterbalance end 230 of the pawl 226 is depressed against the compression spring 232 such that the clasp end 228 of the pawl 226 is caused to pivot away from and release the ratchet gear 222, thereby permitting the axle 220 to freewheel with respect to the spool 234 under the urging of the unwinding torsion spring 236.

To bypass or temporarily defeat the automatic closing function of the closer 200, the operator has a number of options. The operator might choose to disconnect the cable 202 from the sill track 110. He or she might further disconnect the closer 200 from the sliding sash 104 by removing the tongue 204 from the channel 226. The user might engage the brake 206 against the sill track 110 to increase the sliding friction of the sliding sash 104 such that the force of the torsion spring 236 is insufficient to slide the sliding sash 104. The user might also press the button 216 to uncoil the torsion spring 236 and thereby reduce the force available to slide the sliding sash 104.

Although a specific embodiment of the present invention has been described and illustrated, the present invention is not limited to the features of this embodiment, but includes all variations and modifications within the scope of the claims. For example, the invention would be equally applicable to closing sliding screened windows; and the tongue 204 might be replaced by a groove adapted to engage the trailing edge 124 of the sliding sash 104.

The embodiments of the invention in which an exclusive property or privilege is claimed are defined as follows:

1. A device for closing a screened sash that slides substantially horizontally within a frame, the sash having a leading edge which meets the frame and a trailing edge opposite the leading edge, the device comprising:

(a) a housing;

(b) means for engaging the housing to the trailing edge of the sash;

(c) a cable having a first end anchored within the housing and a second end adapted to engage the frame;

(d) an axle passing through the housing transversely to the longitudinal axis of the cable and adapted to rotate freely within the housing;

(e) a spool circumscribing the axle for free rotation thereabout and fixedly retaining the first end of the cable for dispensing or storing the cable;

(f) a ratchet gear fixedly and coaxially engaging the axle;

(g) a pawl having a clasp end and a counterbalance end, the pawl pivotably engaging the housing such that the clasp end is positioned to releasably engage the ratchet gear;

(h) means for urging the clasp end of the pawl to engage the ratchet gear so that the axle remains fixed while the spool rotates out of rotationally alignment therewith; and (i) means for urging the spool back into rotational alignment with the axle whereby as cable is dispensed from the spool, the spool urging means urges the spool to retract the cable.

2. A device as in claim 1, wherein the pawl engagement urging means is a compression spring having a first end affixed to the housing and a second end engaging the counterbalance end of the pawl.

3. A device as in claim 2, wherein the spool urging means is torsion spring having a first end affixed to the spool and a second end affixed to the axle.

4. A device as in claim 3, further including means for ratcheting the axle so as to increase the tension in the torsion spring.

5. A device as in claim 4, further including means for urging the clasp end of the pawl to disengage the ratchet gear so that the axle may freely rotate about the spool.

6. A device as in claim 5, wherein the pawl disengagement urging means is a member that urges the pawl against the pawl engagement urging means.

7. A device as in claim 6, wherein the engaging means is a tongue adapted to engage the trailing edge of the sash.

8. A device as in claim 6, wherein the engaging means is a groove adapted to engage the trailing edge of the sash.

9. A device as in claim 6, further including an elongated member adapted to slideably engage the housing between a first position substantially retracted within the housing and a second position alternate position partially extended from the housing, in which second position the elongated member engages both the housing and the frame to oppose translation therebetween.

* * * * *